US009954323B2

(12) United States Patent
Eriksen

(10) Patent No.: US 9,954,323 B2
(45) **Date of Patent: *Apr. 24, 2018**

(54) CONNECTOR HAVING INSTALLATION-RESPONSIVE COMPRESSION

(71) Applicant: PPC Broadband, Inc., East Syracuse, NY (US)

(72) Inventor: Kim Eriksen, Tappernoeje (DK)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/591,556

(22) Filed: May 10, 2017

(65) Prior Publication Data

US 2017/0244202 A1 Aug. 24, 2017

Related U.S. Application Data

(63) Continuation of application No. 14/715,108, filed on May 18, 2015, now Pat. No. 9,653,823.

(Continued)

(51) Int. Cl.
*H01R 9/05* (2006.01)
*H01R 24/38* (2011.01)

(Continued)

(52) U.S. Cl.
CPC ..... *H01R 24/38* (2013.01); *H01R 13/502* (2013.01); *H01R 9/0518* (2013.01); *H01R 9/0524* (2013.01); *H01R 2103/00* (2013.01)

(58) Field of Classification Search
CPC ..... H01R 9/0518; H01R 9/0524

(Continued)

(56) References Cited

U.S. PATENT DOCUMENTS 6,626,704 B1 9/2003 Pikel
6,790,081 B2 9/2004 Burris et al.

(Continued)

FOREIGN PATENT DOCUMENTS

EP 2149937 A1 2/2010 ..... H01R 13/506
WO WO2010138523 A2 12/2010

OTHER PUBLICATIONS

USPTO (US/ISA), International Search Report and Written Opinion from PCT/US15/31517 (Int'l. Filing Date: May 19, 2015), as completed Jul. 30, 2015 and dated Aug. 19, 2015 (total 10 pages.).

(Continued)

*Primary Examiner* — Tho D Ta
*Assistant Examiner* — Nader Alhawamdeh
(74) *Attorney, Agent, or Firm* — Oliff PLC

(57) ABSTRACT

A connector includes an conductor engager, coupler-driver and a compressor-body. A coupler is disposed over and engages a grounding end of the conductor engager while a torque drive member rotationally drives the coupler to threadably engage an interface port. Threaded engagement of the coupler causes the conductor engager to move forwardly toward the interface port and the torque drive member to move rearwardly relative to the conductor engager. Rearward movement of the torque drive member causes a compressor to slide axially over plurality of radially compliant fingers of the compressor-body. The compliant fingers are displaced radially inward to compress a prepared end of the coaxial cable, i.e., an outer conductor and a radially compliant outer jacket, against a tubular-shaped retention end of the conductor engager. Compression of the prepared end connects the coaxial cable to the connector.

20 Claims, 14 Drawing Sheets

Related U.S. Application Data

(60) Provisional application No. 62/000,170, filed on May 19, 2014.

(51) Int. Cl.
*H01R 13/502* (2006.01)
*H01R 103/00* (2006.01)

(58) Field of Classification Search
USPC ..... 439/578
See application file for complete search history.

(56) References Cited

U.S. PATENT DOCUMENTS

| | | | | |
|---|---|---|---|---|
| 7,128,603 | B2 | 10/2006 | Burris et al. | |
| 7,131,868 | B2 * | 11/2006 | Montena | H01R 9/0518 439/578 |
| 7,513,795 | B1 | 4/2009 | Shaw | |
| 7,892,005 | B2 | 2/2011 | Haube | |
| 7,972,175 | B2 * | 7/2011 | Chawgo | H01R 9/0503 439/583 |
| 8,029,315 | B2 | 10/2011 | Purdy et al. | |
| 8,075,338 | B1 * | 12/2011 | Montena | H01R 9/0524 439/578 |
| 8,079,860 | B1 * | 12/2011 | Zraik | H01R 13/207 439/255 |
| 8,087,949 | B2 | 1/2012 | Palinkas et al. | |
| 8,118,093 | B2 | 2/2012 | Hassell et al. | |
| 8,123,557 | B2 * | 2/2012 | Montena | H01R 9/0527 439/584 |
| 8,167,636 | B1 * | 5/2012 | Montena | H01R 9/0527 439/322 |
| 8,177,583 | B2 * | 5/2012 | Chawgo | H01R 9/0524 439/584 |
| 8,206,169 | B2 | 6/2012 | Palinkas et al. | |
| 8,323,053 | B2 * | 12/2012 | Montena | H01R 9/0524 439/578 |
| 8,708,737 | B2 * | 4/2014 | Chawgo | H01R 9/0524 439/578 |
| 9,130,281 | B2 * | 9/2015 | Phillips, Jr. | H01R 9/0524 |
| 2011/0130025 | A1 | 6/2011 | Palinkas et al. | |
| 2012/0100738 | A1 | 4/2012 | Palinkas et al. | |

OTHER PUBLICATIONS

Oct. 4, 2017 Office Action issued in Danish Patent Application No. PA 2016 70973.

* cited by examiner

CONNECTOR HAVING INSTALLATION-RESPONSIVE COMPRESSION

CROSS REFERENCE TO RELATED APPLICATIONS

This application is a continuation of U.S. Non-Provisional patent application Ser. No. 14/715,108, filed on May 18, 2015 which claims the benefit and priority of, U.S. Provisional Patent Application No. 62/000,170, filed on May 19, 2014. The entire contents of such applications are hereby incorporated by reference.

BACKGROUND

Connectors for coaxial cables typically require several specialized tools employed to couple the connector to the coaxial cable before attaching it to an interface port. For example, compression tools are often employed to compress a deformable outer housing of the connector against the compliant outer jacket of the coaxial cable. In one example, the compression tool axially compresses a bellows ring into the compliant outer jacket. The bellows portion of the ring deforms radially in response to the axial force imposed by the compression tool which, in turn, deforms the compliant outer jacket against a rigid inner conductive post. As such, a friction fit/mechanical interlock is produced between the compliant outer jacket and the rigid inner conductive post.

The aforementioned tools require a degree of proficiency and training regarding their use. For example, the compression tools require proper axial alignment to ensure that the bellows ring deforms uniformly around the periphery of the coaxial cable. Additionally, these tools add to the inventory that installers are required to carry in the course their daily workday. Moreover, these tools can be expensive to fabricate and costly to maintain during their service life.

The foregoing background describes some, but not necessarily all, of the problems, disadvantages and challenges related to cable connectors.

SUMMARY

A thread to compress connector is provided comprising a conductor engager, a coupler driver and a compressor-body . The conductor engager is configured to engage a prepared end of a coaxial cable, i.e., the inner and outer conductors thereof. The a coupler-driver comprises a coupler configured to receive the conductor engager and a torque drive member operative to threadably engage the coupler with an interface port. The torque drive member rotates about an axis to engage threads of the coupler and is displaced rearwardly relative to the coupler upon engagement with a face surface of the interface port. The compressor-body comprises a sleeve having a plurality of radially compliant fingers, and a body configured to: (i) slide over the elongate fingers in response to the rearward displacement of the torque drive member, (ii) compress the fingers radially inwardly in response to the sliding motion of the body, and (iii) retain the prepared end of the coaxial cable relative to the conductor engager.

Additional features and advantages of the present disclosure are described in, and will be apparent from, the following Brief Description of the Drawings and Detailed Description.

DETAILED DESCRIPTION

Network and Interfaces

Figure 1:
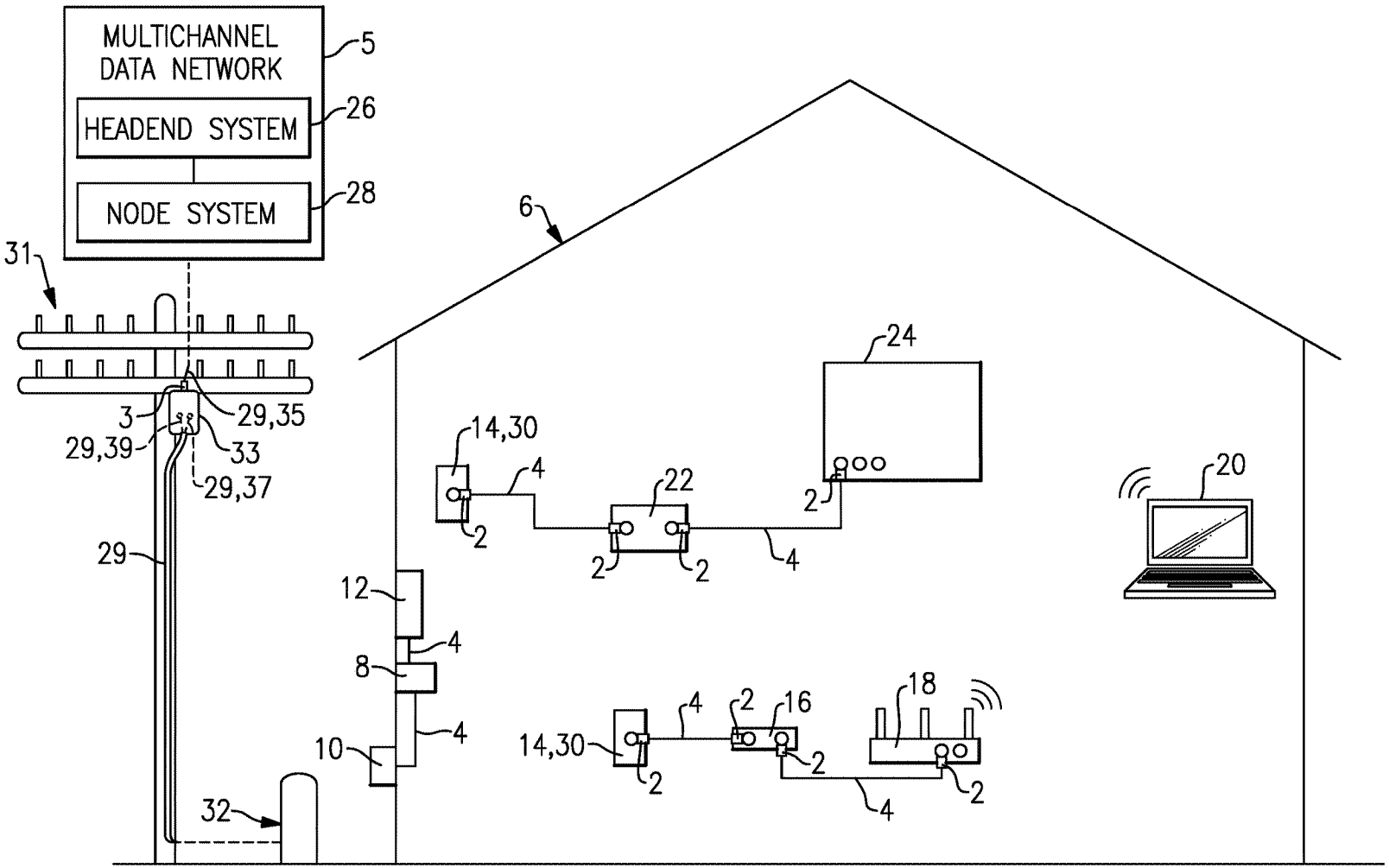
FIG. 1 is a schematic diagram illustrating an environment coupled to a multichannel data network.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment, a drop line coaxial cable or weather-protected or weatherized coaxial cable 29 is connected to the headend facility 26 or node facility 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or pin-type connector 3. The entry junction box device 33 also includes a plurality of output data ports within its weatherized housing. It should be appreciated that such a junction device can include any suitable number of input data ports and output data ports.

The end of the weatherized coaxial cable 35 is attached to a hardline connector or pin-type connector 3, which has a protruding pin insertable into a female interface data port of the junction device 33. The ends of the weatherized coaxial cables 37 and 39 are each attached to one of the connectors 2 described below. In this way, the connectors 2 and 3 electrically couple the cables 35, 37 and 39 to the junction device 33.

In one embodiment, the pin-type connector 3 has a male shape which is insertable into the applicable female input tap or female input data port of the junction device 33. The two female output ports of the junction device 33 are female-shaped in that they define a central hole configured to receive, and connect to, the inner conductors of the connectors 2.

In one embodiment, each input tap or input data port of the entry junction device 33 has an internally threaded wall configured to be threadably engaged with one of the pin-type connectors 3. The network 5 is operable to distribute signals through the weatherized coaxial cable 35 to the junction device 33, and then through the pin-type connector 3. The junction device 33 splits the signals to the pin-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2A:
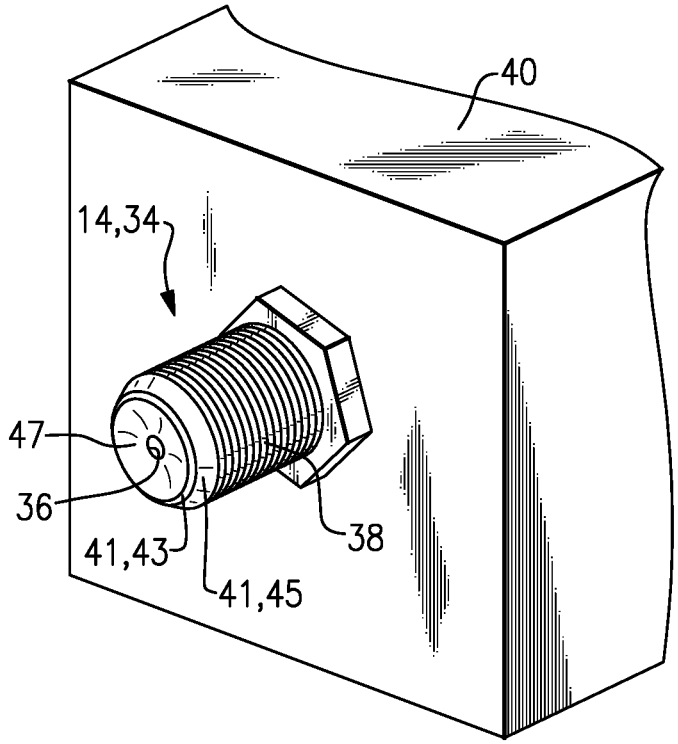
FIG. 2*a* is an isometric view of one embodiment of a female interface port which is configured to be operatively coupled to the multichannel data network.

In one embodiment, shown in FIG. 2*a*, a female interface port 14 includes a cylindrical stud or jack 34*a*. The stud 34*a* has: (a) an inner, cylindrical wall 36 defining a central hole configured to receive an electrical contact, wire, pin, conductor (not shown) positioned within the central hole; (b) a conductive, threaded outer surface 38*a;* (c) a conductive region 41 having conductive contact sections 43 and 45; and (d) a dielectric or insulation material 47.

In one embodiment, stud 34*a* is shaped and sized to be compatible with the F-type coaxial connection standard. It should be understood that, depending upon the embodiment, stud 34*a* could have a smooth outer surface. The stud 34*a* can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34*a*. Once installed, the connector 2 receives the female interface port 34. The connector 2 establishes an electrical connection between the cable 4 and the electrical contact of the female interface port 34*a*.

Figure 2B:
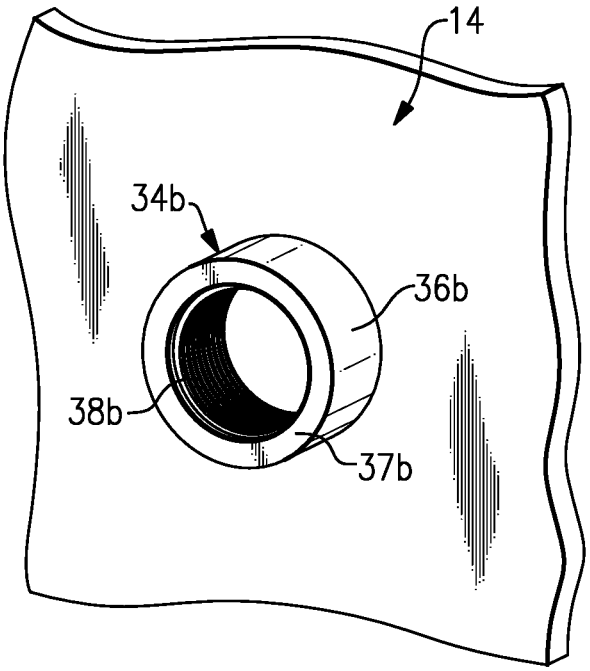
FIG. 2*b* is an isometric view of another embodiment of a female interface port which is configured to be operatively coupled to a pin-type or hardline connector of a coaxial cable.
Figure 4:
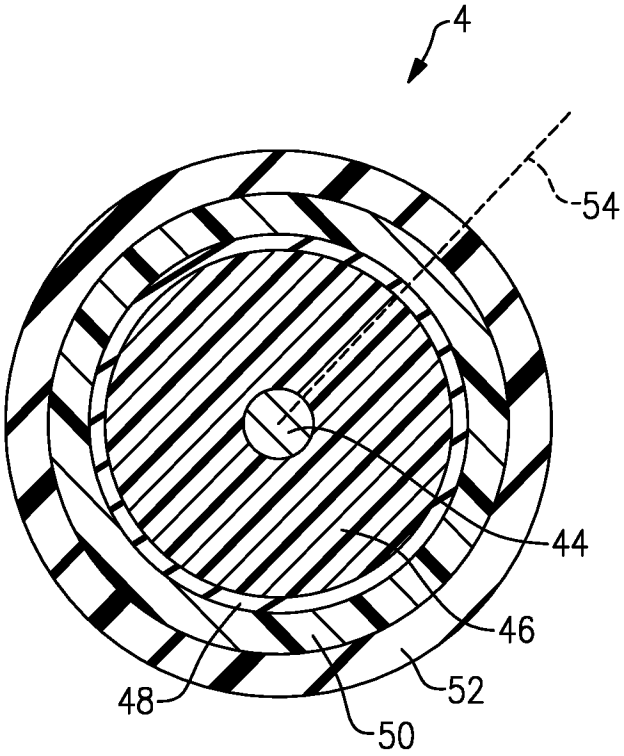
FIG. 4 is a cross-sectional view of the cable of FIG. 3, taken substantially along line 4-4.

In another embodiment shown in FIG. 2*b*, the female interface port 14 includes an internally-threaded tap 34*b*. The interface port 14 includes: (a) a cylindrical sleeve 36*b* defining a central aperture configured to receive an inner electrical contact, wire, pin, or conductor (not shown) positioned within the central aperture, (b) an annular interface surface 37*b* along the top of the cylindrical sleeve 36*b* and (c) a conductive, threaded inner surface 38*b*.

In this embodiment, the tap 34*b* is shaped and sized to be compatible with a pin-type or hard-line connector 3. It should be understood that, depending upon the embodiment, the tap 34*b* could have a smooth inner surface. The tap 34*b* can be operatively coupled to, or incorporated into, a junction box 40 which can distribute the cable signal to several multi-channel networks.

During installation, the installer couples a cable 4 to an interface port 14 by screwing or pushing the connector 3 onto or against the female interface port 14. In the embodiment described in greater detail hereinafter, installation and assembly of a connector 3, 100 may be effected without the need for special tools. That is, the connector 3, 100 may effectuate electrical and mechanical contact between the tap 34*b* of the interface port 14 and the conductors 44, 50 of the coaxial cable 4 without the need for compression tools to create a friction or mechanical interlock therebetween. These features will be discussed in greater detail below.

After installation, the connectors 2 often undergo various forces. For example, there may be tension in the cable 4 as it stretches from one device 40 to another device 40, imposing a steady, tensile load on the connector 2. A user might occasionally move, pull or push on a cable 4 from time to time, causing forces on the connector 2. Alternatively, a user might swivel or shift the position of a TV 24, causing bending loads on the connector 2. As described below, the connector 2 is structured to maintain a suitable level of electrical connectivity despite such forces.

Cable

Referring to FIGS. 3-6, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 3:
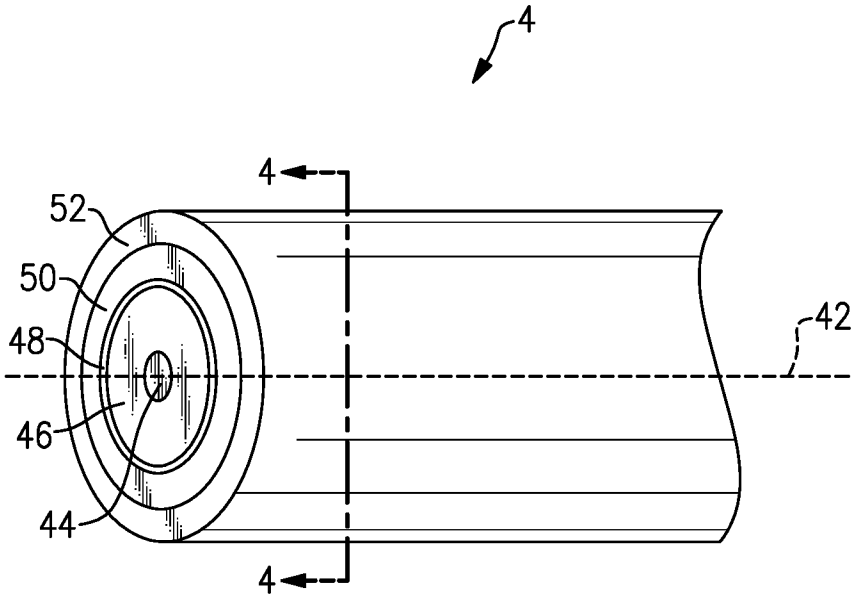
FIG. 3 is an isometric view of one embodiment of a coaxial cable which is configured to be operatively coupled to the multichannel data network.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the connector 2 electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

In one such embodiment, the cable 4 has one or more electrical grounding paths. One grounding path extends from the outer conductor 50 to the cable connector's conductive post, and then from the connector's conductive post to the interface port 14. Depending upon the embodiment, an additional or alternative grounding path can extend from the outer conductor 50 to the cable connector's conductive body, then from the connector's conductive body to the connector's conductive nut or coupler, and then from the connector's conductive coupler to the interface port 14.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure.

Figure 5:
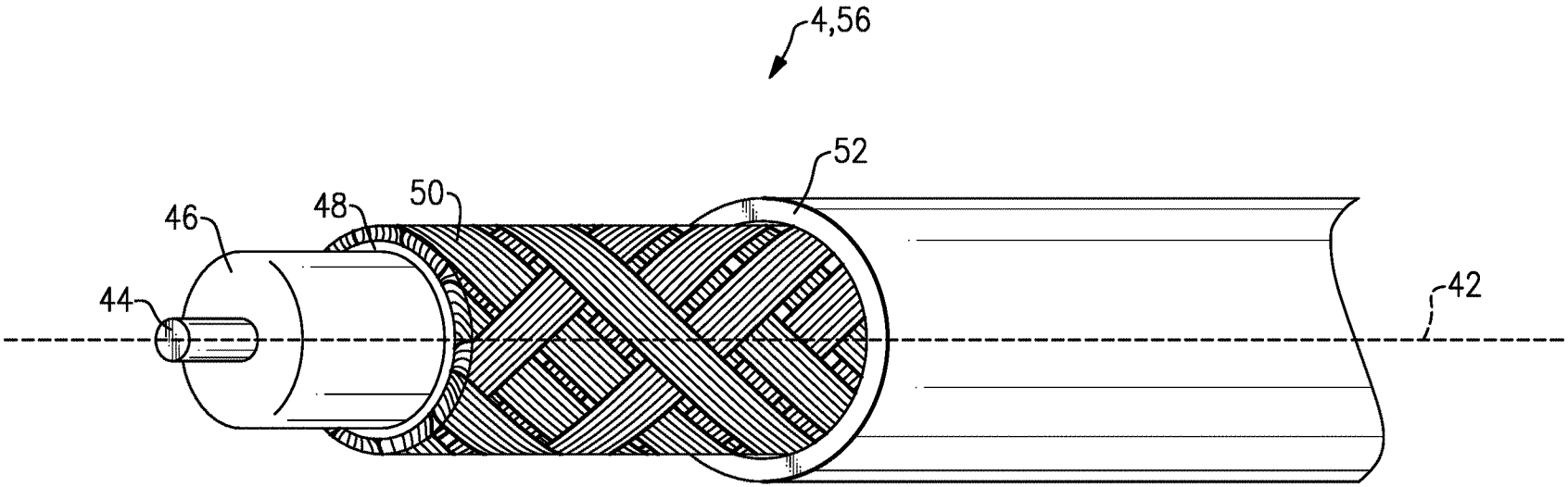
FIG. 5 is an isometric view of one embodiment of a coaxial cable having a three-stepped end configuration.
Figure 6:
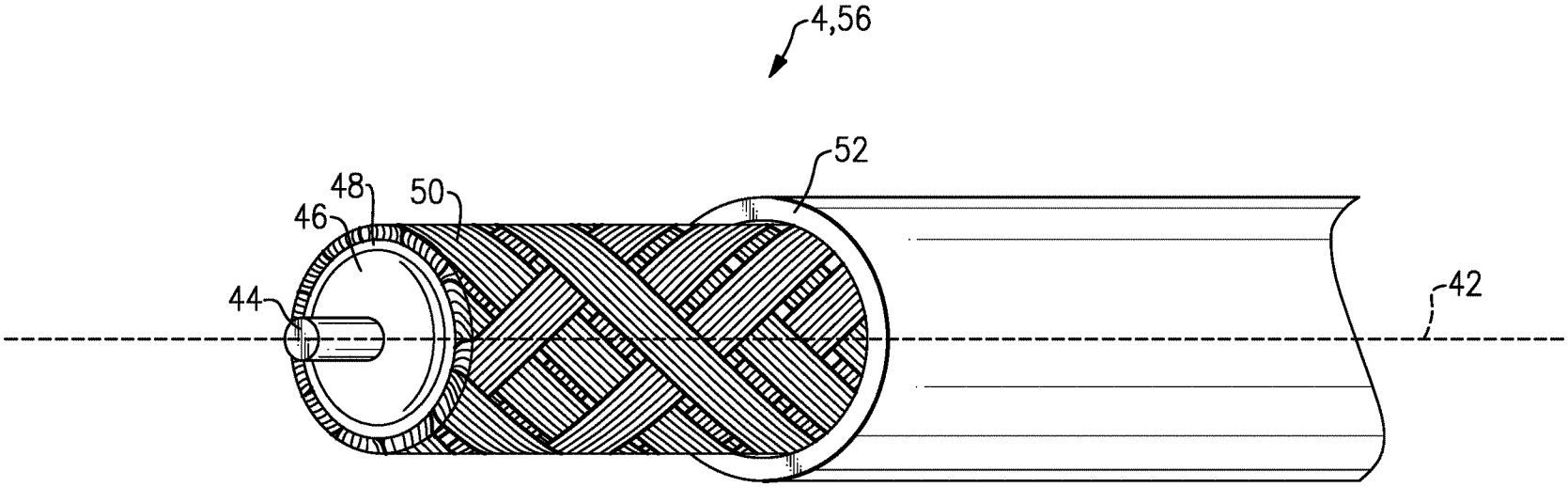
FIG. 6 is an isometric view of one embodiment of a coaxial cable having a two-stepped end configuration.

Referring to FIGS. 5-6, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this point, the cable 4 is ready to be connected to the connector 2.

Figure 7:
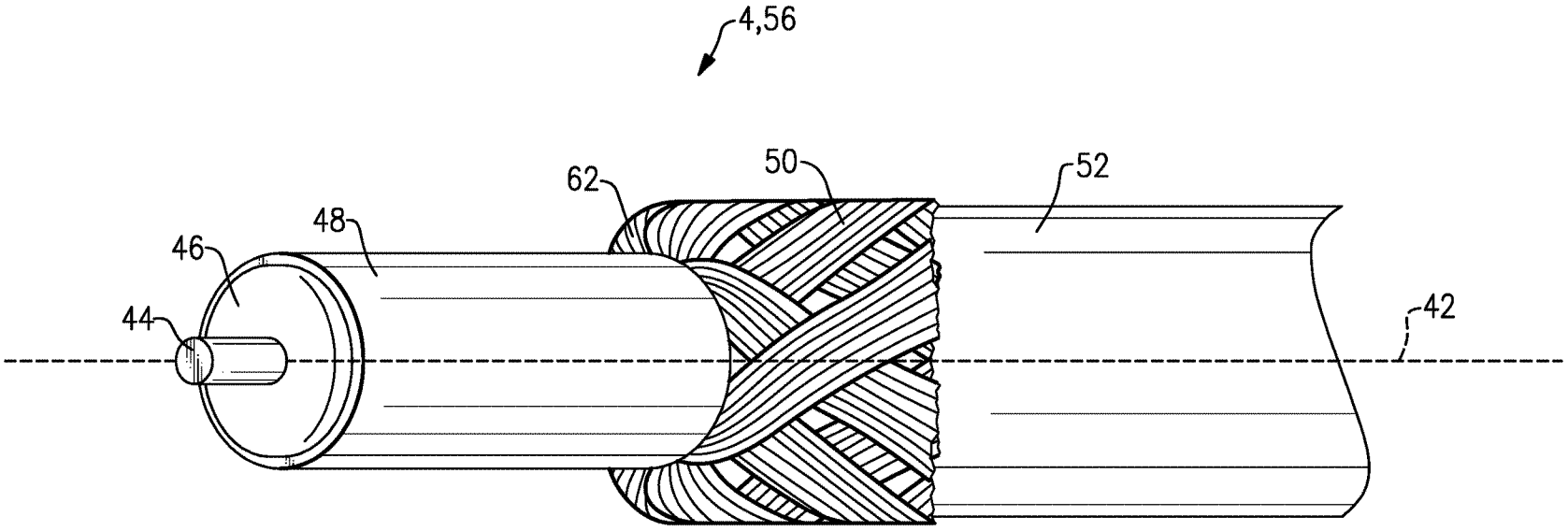
FIG. 7 is an isometric view of one embodiment of a coaxial cable, having a three-stepped end including a folded-back, braided outer conductor.

In one embodiment illustrated in FIG. 7, the installer or preparer performs a folding process to prepare the cable 4 for connection to connector 2. In the example illustrated, the preparer folds the braided outer conductor 50 backward onto the jacket 52. As a result, the folded section 60 is oriented inside out. The bend or fold 62 is adjacent to the foil layer 48 as shown. Certain embodiments of the connector 2 include a tubular post. In such embodiments, this folding process can facilitate the insertion of such post in between the braided outer conductor 50 and the foil layer 48.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 8:
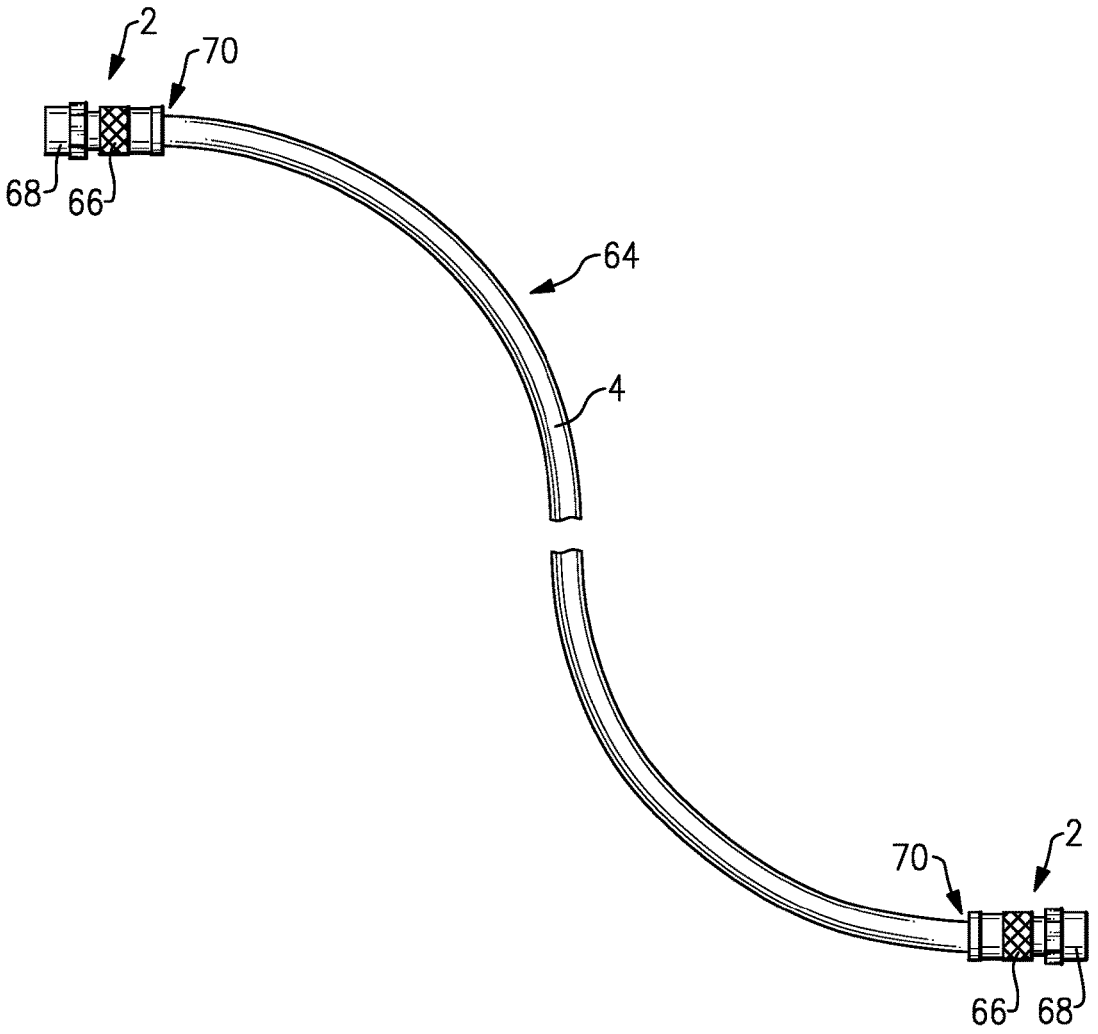
FIG. 8 is a top view of one embodiment of a coaxial cable jumper or cable assembly which is configured to be operatively coupled to the multichannel data network.

In one embodiment illustrated in FIG. 8, a cable jumper or cable assembly 64 includes a combination of the connector 2 and the cable 4 attached to the connector 2. In this embodiment, the connector 2 includes: (a) a connector body or connector housing 66; and (b) a fastener or coupler 68, such as a threaded nut, which is rotatably coupled to the connector housing 66. The cable assembly 64 has, in one embodiment, connectors 2 on both of its ends 70. Preassembled cable jumpers or cable assemblies 64 can facilitate the installation of cables 4 for various purposes.

In one embodiment the weatherized coaxial cable 29, illustrated in FIG. 1, has the same structure, configuration and components as coaxial cable 4 except that the weatherized coaxial cable 29 includes additional weather protective and durability enhancement characteristics. These characteristics enable the weatherized coaxial cable 29 to withstand greater forces and degradation factors caused by outdoor exposure to weather.

Connector

Figure 9:
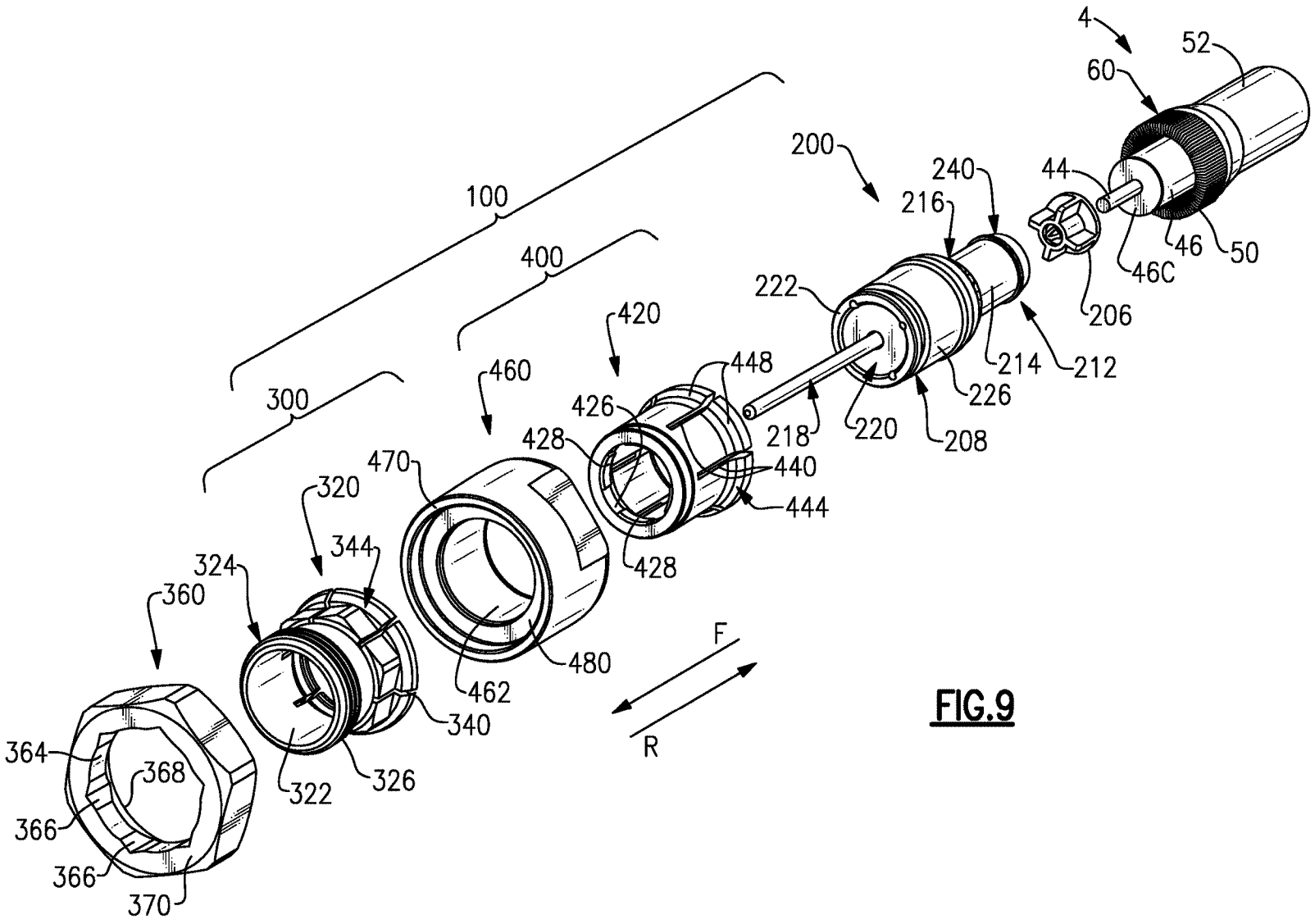
FIG. 9 is an exploded view of an embodiment of a connector including an conductor engager, a coupler-driver and compressor-body which are, inter alia, assembled and operatively coupled with a coaxial cable assembly at one end thereof and with an interface port at the other end to transmit signals to/from the multi-channel data network.
Figure 10:
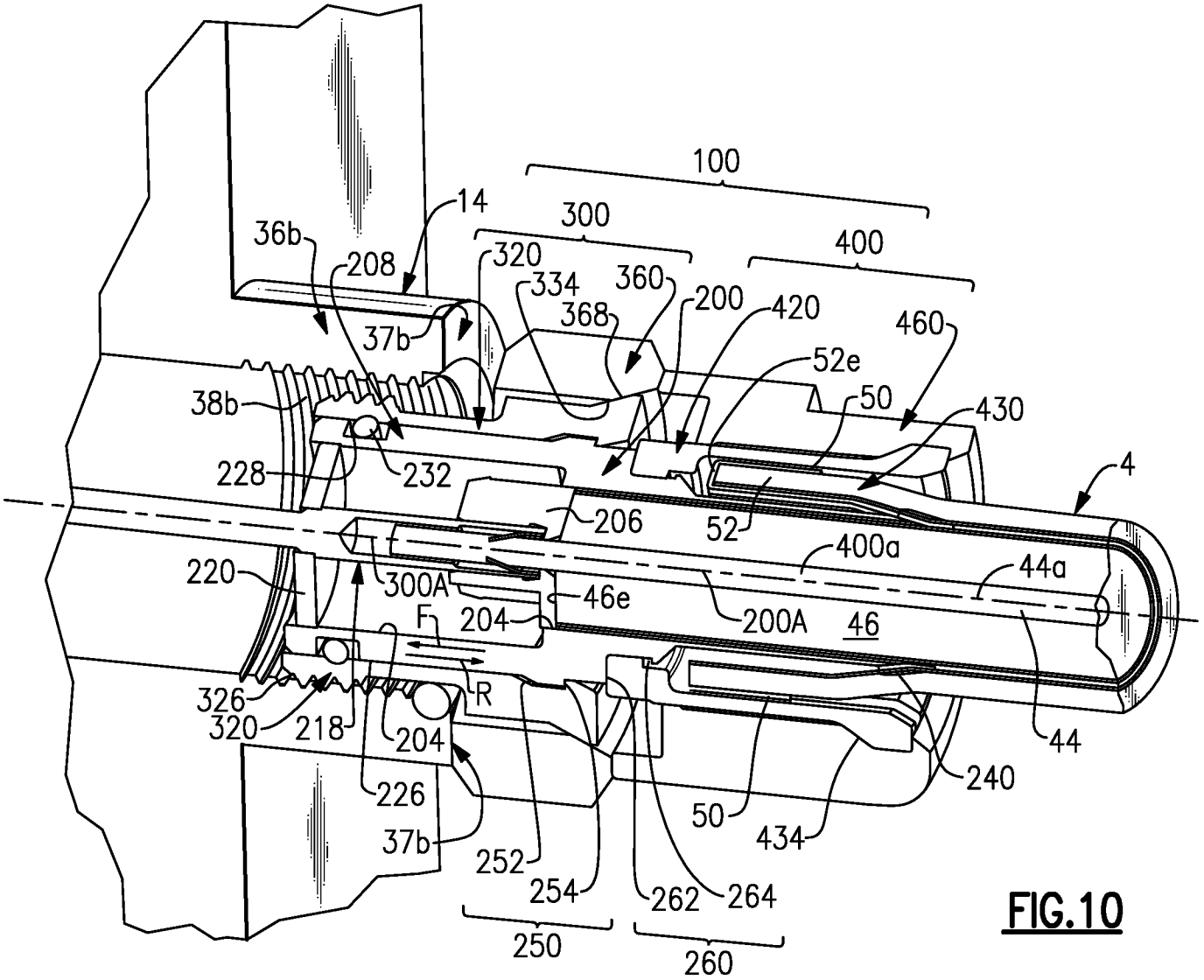
FIG. 10 is an enlarged, partially broken away, sectional view of one embodiment of an assembled connector threadably coupled to an interface port or "tap" of a junction box distributor.
Figure 11:
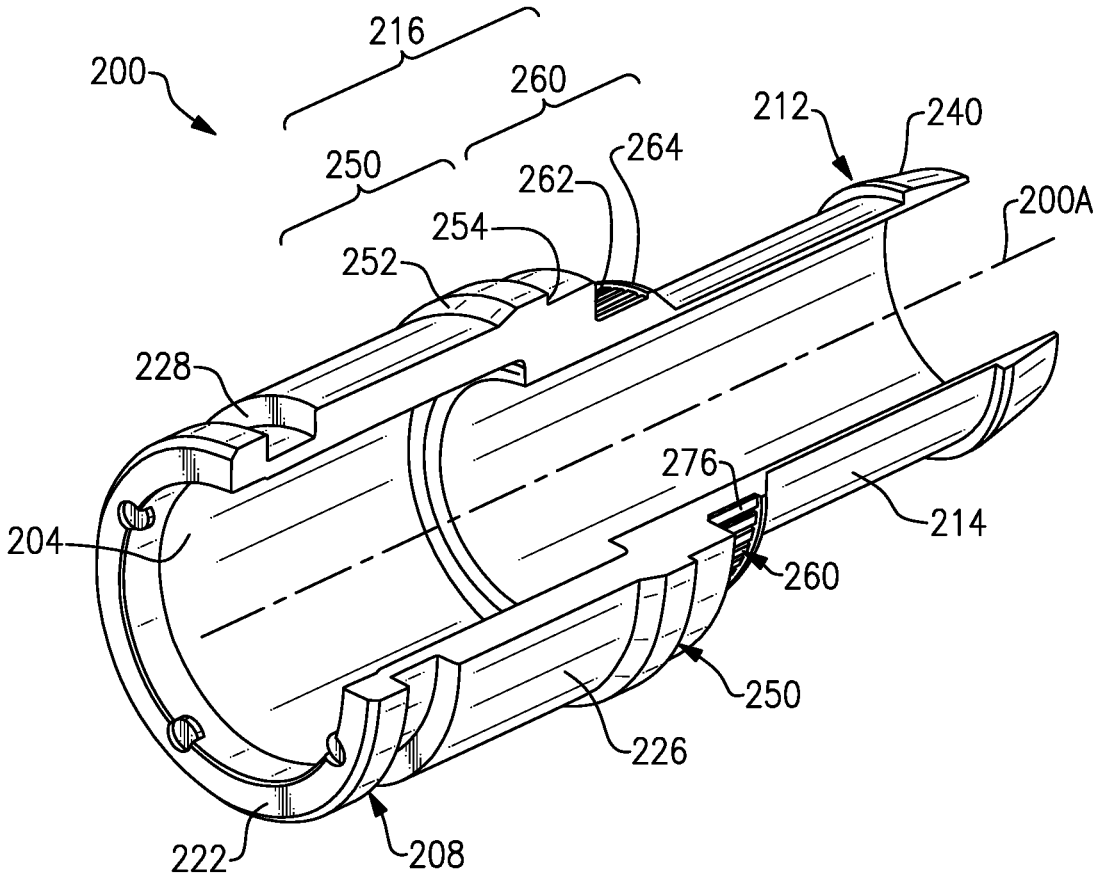
FIG. 11 is an enlarged, sectional view of one embodiment of the conductor engager in isolation to reveal the internal and external structural details for engaging the surrounding component(s) of the assembly.

Referring to FIGS. 9, 10 and 11, cable connector 100 reflects a first embodiment of the cable connector. For the purposes of establishing directional reference, an arrow F denotes a forward direction and an arrow R denotes a rearward direction. Forward displacement or motion is toward the interface port 14 and rearward or aft displacement or motion is away from the interface port 14. The principal components of the connector 100 will be briefly described to provide an overview of the connector 100 followed by a more detailed description of each component using exploded isolated perspective views of each.

The connector 100 includes a conductor engager 200, a coupler-driver 300 and a compressor-body 400. The conductor engager or post 200 is configured to electrically engage a prepared end 60 of a coaxial cable 4 to effect electrical continuity with the inner and outer conductors 44, 50 thereof. The coupler-driver 300 includes a coupler 320 configured to receive the conductor engager 200 and a torque drive member or driver 360 configured to at least partially receive the coupler 320. In one embodiment, the coupler 320 is an externally threaded collar or tubular-shaped member having external threads 324.

The compressor-body 400 includes a radially compliant inner sleeve, body segment or body 420 and a rigid outer compressor segment or compressor 460. The radially compliant inner body 420 is configured to receive the prepared end 60 of the coaxial cable 4. The outer compressor segment or compressor 460 is configured to receive the compliant inner body 420. Furthermore, the outer compressor 460 radially aligns with, is adjacent to, and abuts an aft end of the driver 360.

Operationally, the torque drive member 360 is rotatable about the axis 300A of the coupler-driver 300 and is rotationally connected to the coupler 320. Rotation of the torque drive member 360 causes the external threads 324 of the coupler 320 to engage internal threads 38*b* of the interface port 14. Furthermore, the coupler 320 engages a radial abutment surface or shoulder 254 of the conductor engager 200 to drive the conductor engager 200 axially forward toward the interface port 14. In the described embodiment, the coupler 320 is driven forwardly in the direction of arrow F by the rotational motion of the driver 360. Moreover, when the coupler 320 threadably engages the interface port 14, the torque drive member 360 moves in a rearward direction R relative to the coupler 320, i.e., in response to contact of the driver 360 with a face surface 37*b* (see FIG. 10) of the interface port 14. Inasmuch as the torque drive member 360 is rotationally fixed to the coupler 320 yet free to move axially with respect thereto, the rearward linear motion of the torque drive member 360 may be transferred to the compressor 460 of the compressor-body 400. The rearward linear motion of the compressor 460 is then transferred to the radially compliant inner body 420 of the compressor-body 400. Finally, the radially compliant inner body 420 applies a radially inward "gripping" force to the prepared end 60 of the coaxial cable 4. The motions and connections effected by the various connector element/components will become apparent in view of the following detailed description of each element/component in isolation.

FIG. 11 depicts an isometric view of the conductor engager 200. The conductor engager 200 includes a central bore or aperture 204 (best seen in FIG. 11), a first or ground connection end 208, a second or compression retention end 212, and an transition attachment region 216 disposed therebetween. The central bore or aperture 204 receives the inner conductor 44 of the cable 4 and defines an elongate axis 200A which is substantially coincident with the elongate axis 44A of the inner conductor 44. The inner conductor 44 is prepared by removing/cutting a portion of the dielectric core 46 such that a portion of the inner conductor 44 extends beyond the step or cut in the terminal end 46*e* of the dielectric inner core 46. The inner conductor 44 may be supported by a fitting 206 which is inserted within the aperture 204 of the conductor engager 200 to center the inner conductor 44 therein. The inner conductor 44 may be received by an inner conductor engager 218 which is also supported within the aperture 204 by a disc-shaped insulator 220. The disc-shaped insulator 220 electrically insulates the signal-carrying inner conductor 44 from the first or ground connection end 208 of the conductor engager 200 (discussed in a subsequent paragraph below).

The first or ground connection end 208 includes a forward face 222 and outer periphery 226 which engage an inner surface of the coupler 320 (see FIG. 9). An outwardly facing circumferential groove 228 is formed along the outer periphery 226 for receipt of an O-ring seal 232 for preventing water and moisture from infiltrating the electrical interface between the outer periphery 226 of the conductor engager 200 and the conductive threaded interface of the coupler driver 300. As such, an electrical ground path is created and maintained between the first or ground connection end 208 of the conductor engager 200 and the conductive cylindrical sleeve 36*b* of the interface port 14.

The compression retention end 212 includes an annular barb 240 and a thin-walled cylindrical sleeve 242 connecting the annular barb 240 to the transition attachment region 216 of the conductor engager 200. The cylindrical sleeve 242 and annular barb 240 are received between the dielectric inner core 46 and the folded end portion 60 of the braided outer conductor 50. The preparation of the outer conductor 50, i.e., the steps of cutting and folding the end over the outer compliant jacket 52, is performed in the same manner as described supra in connection with the cable 4 in FIGS. 3-6. Once inserted between the conductive braid 50 and the dielectric core 46, the annular barb 240 retards or resists separation of the conductor engager 200 from the coaxial cable 4. Later it will be seen how a portion of the compressor-body 400 engages the compression retention end 212 to effect an electrical and mechanical connection between the compressor-body 400 and the conductor engager 200.

The transition attachment region 216 is disposed between the grounding and compression retention ends 208, 212, and includes: (i) a unidirectional retention lip or shoulder 250 and (ii) a bi-directional retention groove 260. The unidirectional retention lip or shoulder 250 includes a tapered surface 252 along a forward end of the shoulder 250 and a radial abutment surface 254 along an aft or rearwardly facing end of the shoulder 250. Functionally, the radial abutment surface 254 of the unidirectional shoulder 250 engages the coupler-driver 300 such that axial motion of the coupler 320 toward the interface port 14 is transferred to the conductor engager 200. That is, when the coupler 320 is rotationally driven about the axis 200A by the torque drive member 360, the torque drive member 360 engages the face surface 37*a* (FIG. 10) of the interface port 14. After a prescribed axial displacement of the torque drive member 360, the torque drive member 360 engages a plurality of retention fingers of the coupler 320 to fit the coupler 320 over the lip 250 of the conductor engager 200. The bi-directional retention groove 260 includes a large, or deep, retention surface 262 and a small, or shallow, retention surface 264. Functionally, the bi-directional retention groove 260 engages and retains the compressor-body 400 while facilitating hand-installation of the coupler-driver 300 to the conductor engager 200. That is, the shallow retention surface 264 allows an installer to snap-fit a retention flange into the bi-directional retention groove 260 of the conductor engager 200.

Figure 12:
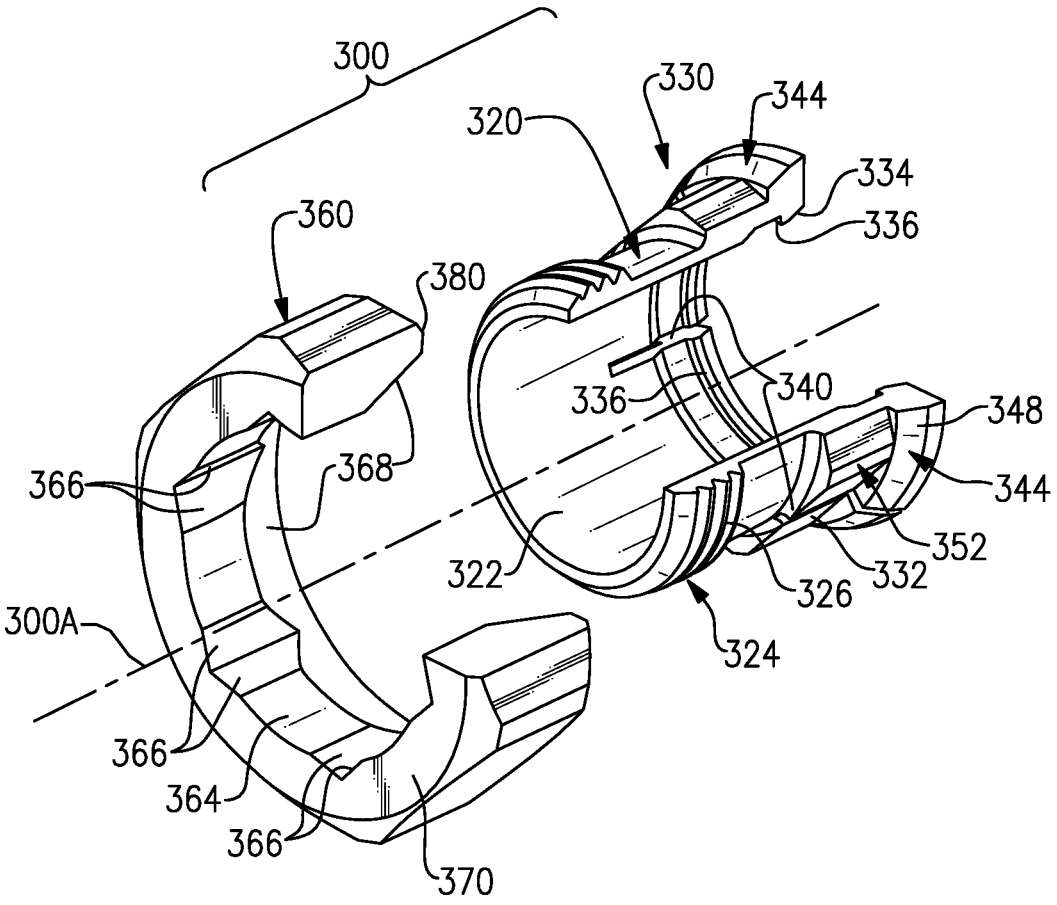
FIG. 12 is an enlarged, sectional view of one embodiment of the coupler-driver including an inner coupler and an outer driver each being shown in isolation to reveal the structural details which engage the surrounding component(s) of the assembly.

In FIGS. 9, 10 and 12, the coupler driver 300 includes a coupler 320 and a torque drive member 360. The coupler 320 includes an aperture 322 for receiving the grounding end 208 of the conductor engager 200 and defines a rotational axis 300A which is coaxial with the elongate axis 200A of the conductor engager 200. Additionally, the coupler 320 comprises a threaded end 324 having a plurality of outwardly facing threads 326 and a transmission end 330 having at least one torque drive surface 332. The outwardly facing threads 326 of the coupler 320 are configured to engage the inwardly facing threads 38*b* of the interface port 14. In the described embodiment, the threaded end 324 comprises only as many spiral threads are needed to reliably draw the coupler 320 into the threaded interface port 14. Externally, along the outer periphery of the transmission end 330, a plurality of torque drive surfaces 332 define a hexagonal shape. Internally, along the inner periphery, the transmission end 330 includes: (i) an inclined or sloping annular engagement surface 334, and (ii) an internal engagement surface 336 configured to engage the radial abutment surface 254 of the conductor engager 200, i.e., along the unidirectional shoulder 250 thereof. The annular engagement surface 334 of the coupler 320 engages the radial abutment surface 254 of the conductor engager 200 to drive the conductor engager 200 axially toward the interface port 14 while facilitating rotational motion of the torque drive member 360, i.e., serving as a sliding journal bearing interface, relative to the conductor engager 200.

The transmission end 330 of the coupler 320 also includes a plurality of axial slots 340 which are equally spaced, i.e., equiangular, about the rotational axis 300A. The axial slots 340 define a plurality of radially compliant segments 344 each having a portion of the sloping engagement surface 334. The axial slots 340 extend through each of the torque drive surfaces 332 and through the internal engagement surface 336 of the coupler 320. In the described embodiment, the transmission end 330 includes six (6) axial slots 336 producing six (6) radially compliant segments 344.

The torque drive member 360 includes an aperture 364 for receiving the threaded end 324 of the coupler 320 and is rotationally coupled to the torque drive surfaces 332 at the transmission end of the coupler 320. More specifically, the torque drive member 360 includes an a inner periphery having a plurality of torque drive surfaces 366 which complement at least a portion of the outer periphery of the coupler 320 at the transmission end 330. That is, the torque drive surfaces 366 along the inner periphery of the torque drive member 360 may mirror or complement the shape of, for example, each point 352 of the hexagonally-shaped outer periphery of the coupler 320. Additionally, the inner periphery of the torque drive member 360 defines a conical or frustum shaped surface 368 for engaging the sloping engagement surfaces 334 of each radially compliant segment 344.

Structurally, the torque drive member 360 is disposed over the coupler 320 such that the torque drive surfaces 366 engage each point 352 produced by the hexagonally-shaped outer periphery of the coupler 320. The torque drive member 360 is rotationally fixed with respect to the coupler 320, i.e., along the rotational axis 300A, but is free to move axially along the axis 300A, between the sloping engagement surfaces 334 of each radially compliant segment 344 and the annular interface surface 37*b* of the port 14. Operationally, the torque drive member 360 rotates to threadably engage the coupler 320 into the threaded inner surface 38*b* of the interface port 14. After a predetermined number of rotations, the coupler 320 will cause a front face surface 370 of the torque drive member 360 to engage the annular interface surface 37*b* of the port 14. At the same time, the conductor engager 200 is displaced axially along with the coupler 320, as the internal engagement surface 336 drives the radial abutment surface 254 of the conductor engager 200. Continued rotation of the torque drive member 360 causes the coupler 320 to displace further into the port 14 while the front face surface 370 transfers the relative axial motion of the torque drive member 360, i.e., the relative axial motion between the torque drive member 360 and the underlying conductor engager 200, to the compressor-body 400. Furthermore, continued rotation of the torque drive member 360 converts the relative axial motion to a radial displacement of the each of the radially compliant segments 344 as the conical surface 368 engages the inclined surface 348 of each segment 344. This displacement will be described further following the description of the compressor-body 400 in the subsequent paragraphs below.

Figure 13:
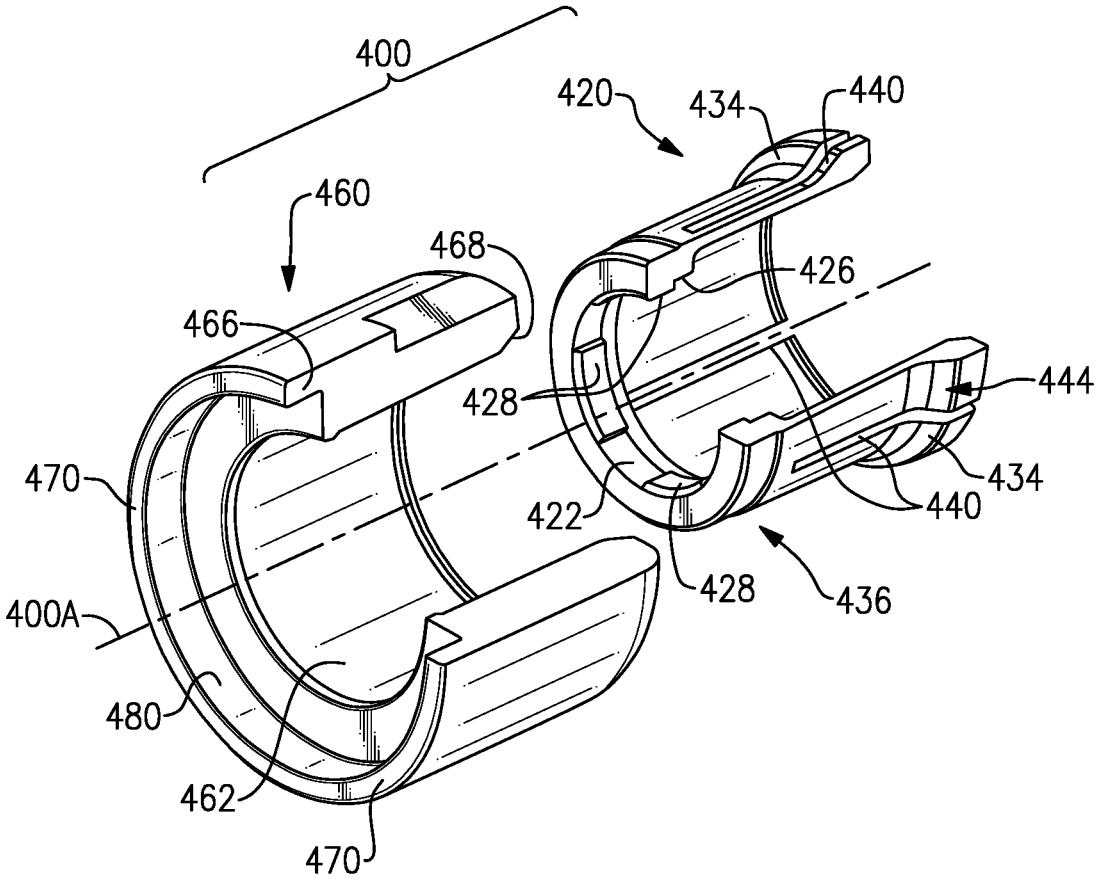
FIG. 13 is an enlarged, sectional view of one embodiment of the compressor-body including an inner body and an outer compressor each being shown in isolation to reveal the internal and external structural details for engaging the surrounding component(s) of the assembly.

In FIGS. 9, 10, and 13, the body 420 of the 400 includes an aperture 422 for receiving the conductor engager 200 and an inwardly projecting flange 426, at a forward end for engaging the bi-directional retention groove 260 of the conductor engager 200. The inwardly projecting flange 426 also includes a plurality of raised arcuate segments 428 configured to engage a plurality of axial splines 276 formed within the bi-directional retention groove 260. The segments 428 engage the splines 276 to rotationally couple the body 420 to the conductor engager 200.

The body 420 is disposed over the cylindrical sleeve 214 of the conductor engager 200 and defines an annular cavity 430 (see FIG. 9) for accepting the prepared end, or folded portion 60, of the cable 4. The external periphery of the body 420 includes an inclined outer surface 434 which increases diametrically in a rearward direction R. The internal periphery includes a cylindrical inner surface 438 for engaging and compressing the prepared end 60 of the cable 4 during installation. Furthermore, the body 420 includes a plurality of axial slots 440 producing a plurality of radially compliant fingers 444, each compliant finger including a portion of the inclined outer surface 434.

The compressor 460 has a substantially cylindrical shape and includes an aperture 462 for receiving a forward end 436 of the body 420. Furthermore, the compressor 460 includes a cylindrically-shaped lip 466 projecting axially toward the torque drive member 360 of the coupler driver 300. The cylindrically shaped lip 466 also defines a cavity 480 which provides a shallow recess for receiving the transmission end 330 of the coupler 320, in preparation for assembly/installation of the connector 100. Additionally, the compressor 460 includes a conical or frustum-shaped surface 468 which is operative to engage the inclined outer surface 434 of the body 420. Structurally, the frustum shaped inner surface 468 engages the inclined outer surface of each compliant finger 444 to drive the respective finger 444 radially downward to compress the outer jacket 52 and outer conductor 50 against the cylindrical sleeve 214 of the conductor engager 200.

Figure 14:
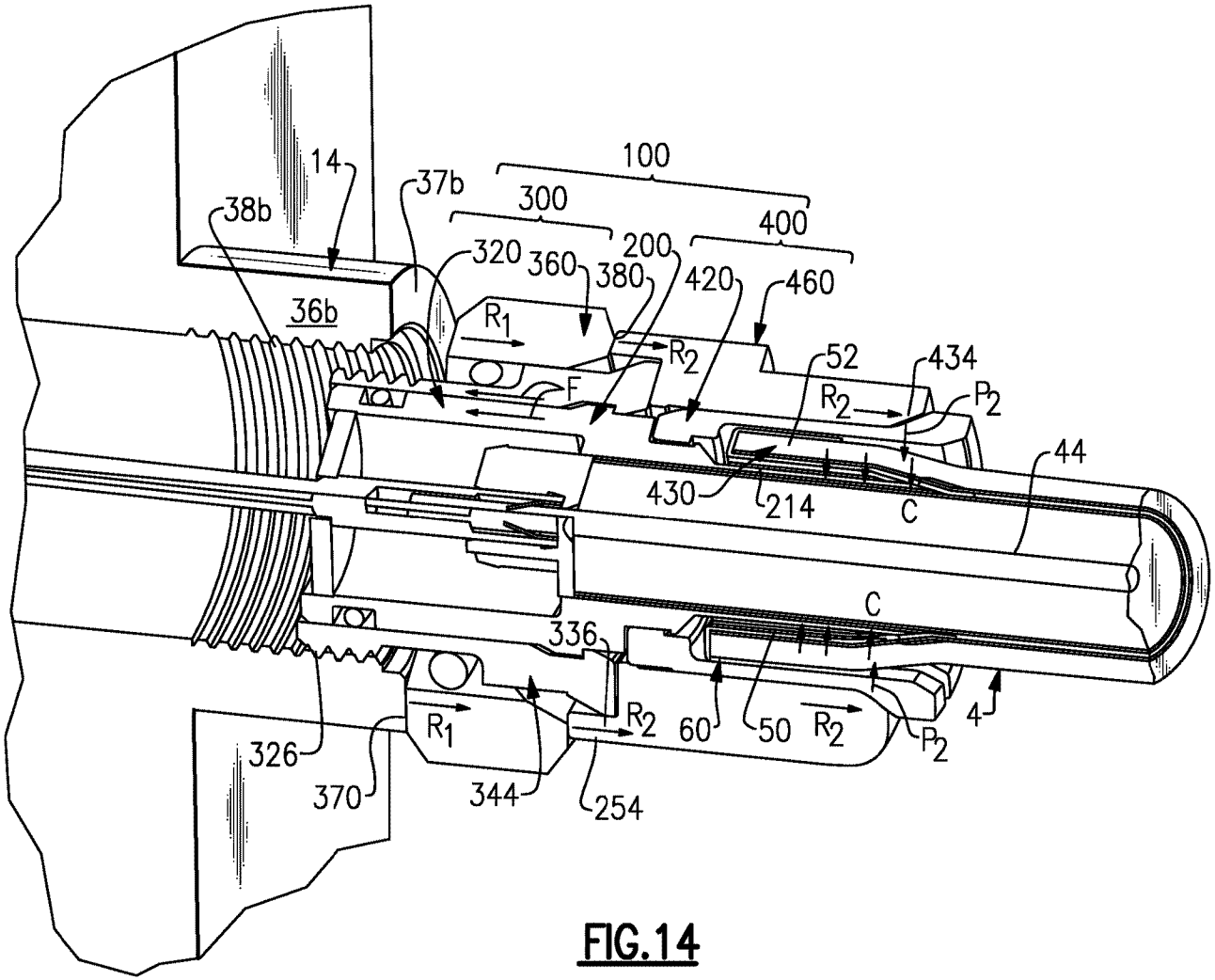
FIG. 14 is an enlarged, partially-broken away, sectional view of one embodiment of an uncoupled connector in preparation for engaging a threaded interface port.
Figure 15:
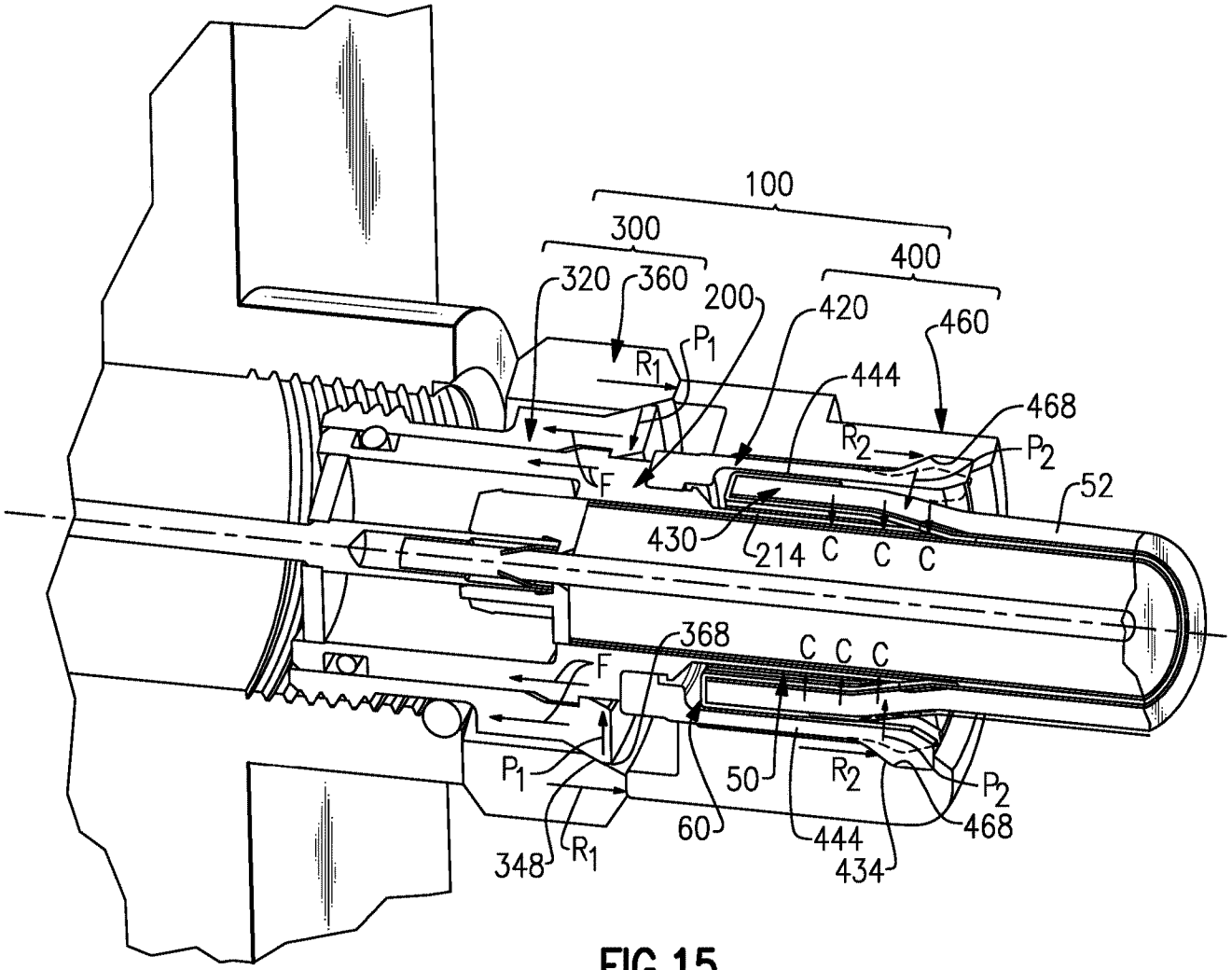
FIG. 15 is an enlarged, partially-broken away, sectional view of one embodiment of an coupled or assembled connector threadably engaged with a threaded interface port.

FIGS. 14 and 15 depict the connector 100 immediately prior to assembly/installation (FIG. 14) and subsequent to assembly installation (FIG. 15). In FIG. 14, the prepared end 60 of the coaxial cable 4 is installed within the annular cavity 430, between the body 420 and the cylindrical sleeve 214 of the conductor engager 200. The compressor-body 400 is slid over the compression retention end 212 of the conductor engager 200 such that the inwardly projecting flange of the body 420 engages the retention groove 260 of the transition attachment portion of the conductor engager 200. Furthermore, the coupler driver 300 is slid over the other end or the grounding end 208 of the conductor engager 200. Specifically, the radially compliant segments 344 allow the coupler 320 to snap-fit over the retention shoulder 250 of the conductor engager 200.

In the described embodiment, the outwardly facing threads 326 engage the inwardly facing threads of the interface port 14. While the described embodiment shows the coupler 320 threadably engaging the port 14, it will be appreciated that other coupling interfaces are contemplated. For example, an axial, friction-fit or push-on connection may be employed.

The torque drive member 360 is rotationally fixed with respect to the coupler 320, yet is axially free to move along the axis 300A. Operationally, the torque drive member 360 rotates to threadably engage the coupler 320 into the threaded inner surface **38*b* of the interface port 14. After a predetermined number of rotations, the coupler 320 will cause a front face surface 370 of the torque drive member 360 to engage the annular interface surface 37*b* of the port 14. At the same time, the conductor engager 200 is displaced axially with the coupler 320, i.e., as the internal engagement surface 336 drives the radial abutment surface 254 of the conductor engager 200. Continued rotation of the torque drive member 360 causes the coupler 320 to displace further into the port 14, i.e., in a forward direction F. The forward motion F of the coupler 320 translates into a rearward motion $R_1$ of the torque drive member 360 as the front face surface 370 thereof engages the planar surface 37*b* of the interface port 14 normal to the rotational axis 300A. The rearward motion $R_1$ of the torque drive member 360 is transmitted/transferred to the compressor 460 as the rearwardly facing surface 380 of the torque drive member engages the front face 470 of the compressor-body 400, i.e., along the protruding lip 466. Furthermore, continued rotation of the torque drive member 360 converts the relative motion $R_2$ into a radial displacement $P_1$ (shown in FIG. 15) of each of the radially compliant segments 344, i.e., as the conical surface 368 engages the inclined surface 348 of each segment 344. The radial displacement of the compliant segments 344 closes gaps between the coupler 320 and the conductor engager 200 which may otherwise be a source of RF ingress/egress into/out of the connector 100**.

In FIG. 15, the torque drive member 360 is fully displaced, rearwardly along arrow $R_1$, which, in turn, displaces the compressor 460 along arrow $R_2$. The frustum surface 468 of the compressor 460 engages each of the radially compliant fingers 444 along a portion of the mating conical surface 434. The rearward displacement $R_2$ of the compressor 460 produces an inward radial force $P_2$ to the body 420, shown in dashed lines in FIG. 15. The radial force $P_2$ produces a compressive force C along the prepared end 60 of the coaxial cable 4.

In the described embodiment, compression tools typically required for assembly/coupling of a connector 100 are eliminated. The connector 100 eliminates the need for compression tools though the use of a rotationally fixed/axially floating torque drive member 360 to axially engage a compressor 460 during installation of the connector as shown in FIG. 15.

In one embodiment, a method for effecting a coaxial cable connection comprises the steps of:

(a) preparing the end 60 of a coaxial cable 4 such that an inner conductor 44 extends past the terminal end 46E and the outer conductor 50 is folded back over an outer jacket 52 of the coaxial cable 4;

(b) inserting a compression retention end 212 of an conductor engager 200 between the outer jacket 52 and an insulating core 46;

(c) sliding a compressor body 400 over the prepared end 60 such that the body 420 produces an annular cavity 430 for receiving the prepared end 60;

(d) sliding a coupler driver 300 over a grounding end 208 of the cable 4 such that the coupler 320 engages a unidirectional shoulder 254 of the conductor engager 200;

(f) inserting the threads 326 of the coupler 320 into the threaded interface surface 38*b* of the interface port 14;

(g) rotating the coupler 320, via the torque drive member, to threadably engage the interface port 14 such that as the coupler 320 engages the threads, the torque drive member 360 transfers the relative axial motion of the coupler 320 relative to the torque drive member 360 to the compressor body; and wherein the compressor 460 applies a radial inward force P2 on the body to compress the outer jacket 52 and outer conductor 50 against the conductor engager 200 thereby securing the connector 100 to the prepared end 60 of the cable 4.

Once secured, the connector is permanently secured to the cable 4 such that a technician/installer can re-assemble the connector 100 onto the same or a different port 14 without the need to re-attach the cable 4 to the connector 100.

In another embodiment, the connector 100 has the same structure and components except that it is configured for installation with an F-type interface port, such as interface port 14 shown in FIG. 2*a*. In this embodiment, a coupler 300 includes internal threads for coupling to a port 14 having external threads. The torque drive member 360 is elongated to as to protrude axially forward of the coupler nut. When the end of the elongated torque drive member abuts the port wall 14, the coupler nut (i) continues to be driven internally by rotation of the elongated nut and (ii) drives the compressor rearwardly in the manner described above. That is, the relative movement causes the compressor to drive the body radially inward to compress the outer jacket, thereby securing the prepared end to the connector 100. Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A thread-to-compress connector, comprising:

a post configured to engage a prepared end of a coaxial cable;

a coupler configured to engage an interface port and having a portion which moves in a rearward direction upon engagement with the interface port; and a compressor configured to be disposed over the post and the prepared end of the coaxial cable, the compressor having a plurality of radially compliant fingers and a sleeve configured to slide over the radially compliant fingers in response to the rearward displacement of the moveable portion of the coupler, the radially compliant fingers being compressed inwardly by the sleeve and against the post to retain the prepared end of the coaxial cable.

2. The thread-to-compress connector of claim 1 wherein the coupler threadably engages the interface port and wherein the post is received within a bore of the coupler.

3. The thread-to-compress connector of claim 1 wherein coupler includes a first portion configured to threadably engage the interface port and a second portion configured to impart torque to the first portion of the coupler.

4. The thread-to-compress connector of claim 1 wherein the moveable portion of the coupler engages a face surface of the interface port.

5. The thread-to-compress connector of claim 2 wherein coupler includes a plurality of inwardly-projecting shoulder segment configured to engage an outwardly-projecting annular ring of the post, the annular ring of the post engaging the inwardly-projecting shoulder segments of the coupler to axially draw the post toward the interface port as the coupler threadably engages the interface port.

6. The thread-to-compress connector of claim 1 wherein the post includes a tubular shaped retention end for accepting the prepared end of the coaxial cable and wherein the radially compliant fingers are disposed over the prepared end of the coaxial cable in a region corresponding to the tubular shaped retention end such that rearward axial displacement of the sleeve causes the radially compliant fingers to close over and retain the prepared end of the coaxial cable.

7. The thread-to-compress connector of claim 1 wherein the post includes first end disposed through a bore in the coupler, a second end receiving the prepared end of the coaxial cable and a transition attachment region therebetween, the transition attachment region including a bi-directional retention groove for retaining an inwardly projecting flange of the compressor.

8. The thread-to-compress connector of claim 5 wherein the outwardly-projecting annular ring of the post facilitates rotation of the coupler when the coupler threadably engages the coupler with the interface port.

9. The thread-to-compress connector of claim 5 wherein the inwardly projecting compliant segments snap fit over the outwardly-projecting annular ring of the post to facilitate in-field manual assembly of the connector.

10. A thread-to-compress connector, comprising:

a conductive post;

a coupler having a first portion rotatable relative to the post for driving the post into electrical contact with an interface port and a second portion moveable relative to the first portion in a rearward direction upon engagement the interface port;

a body having a plurality of radially compliant fingers disposed over an outer conductor of a prepared end of a coaxial cable; and a compressor, responsive to the rearward motion of the coupler, configured to bias the radially compliant fingers against the outer conductor of the coaxial cable.

11. The thread-to-compress connector of claim 10 wherein the compressor is configured to retain the prepared end of the coaxial cable relative to the post.

12. The thread-to-compress connector of claim 10 wherein the coupler threadably engages the interface port and wherein the post is received within a bore of the coupler.

13. The thread-to-compress connector of claim 10 wherein the first portion is configured to threadably engage the interface port and the second portion is configured to impart torque to the first portion of the coupler.

14. The thread-to-compress connector of claim 10 wherein the second portion of the coupler engages a face surface of the interface port.

15. The thread-to-compress connector of claim 10 wherein the post includes first end disposed through a bore in the coupler, a second end receiving the prepared end of the coaxial cable and a transition attachment region therebetween, the transition attachment region including a bi-directional retention groove for retaining an inwardly projecting flange of the compressor.

16. The thread-to-compress connector of claim 10, wherein the rearward motion of the second portion of the coupler and its compressive effect on the compressor produces a non-reversible mechanical and electrical connection, between the body and the post.

17. A method for establishing a non-reversible mechanical and electrical connection between a connector and a prepared end of a coaxial cable, comprising the steps of:

effecting a threaded connection between a first portion of a coupler and an interface port;

configuring the first portion of the coupler to receive a forward portion of a post and a second portion to (i) impart torque to the first portion to effect the threaded connection, (ii) engage a surface of the interface port while imparting torque to the first portion, and (iii) be displaced rearwardly relative to a first portion of the coupler when engaging the interface port; and compressing a plurality of radially compliant fingers disposed around an aft portion of the post to establish a non-reversible mechanical and electrical connection between the compliant fingers and the post of a coaxial cable connector in response to the rearward displacement of the second portion of the coupler.

18. The method according to claim 17 wherein the step of compressing the plurality of radially compliant fingers includes the steps of: disposing a sleeve over the radially compliant fingers such that one end of the sleeve is aligned with the second portion of the coupler, and sliding the sleeve over the radially compliant fingers such that an inwardly facing inclined surface of the sleeve engages an outwardly facing inclined surface formed on each compliant finger thereby causing the compliant fingers to collectively engage and retain the prepared end of the coaxial cable upon rearward displacement of the sleeve.

19. The method according to claim 17 wherein the step of configuring the first portion of the coupler to receive a forward portion of a post includes the steps of:

segmenting the forward portion of the coupler such that the forward portion of the post is received within a bore formed in the forward portion of the coupler and snapped into engagement therewith around an outwardly protruding annular ring of the post.

20. The method according to claim 17 wherein the step of configuring the first portion of the coupler to receive a forward portion of a post includes the steps of:

providing an annular seal between an outwardly facing surface of the post and an inwardly facing surface of the coupler.

* * * * *